US009592938B2

(12) United States Patent
Kobashi et al.

(10) Patent No.: US 9,592,938 B2
(45) Date of Patent: Mar. 14, 2017

(54) ROTATION MECHANISM AND CASE ASSEMBLY USING THE SAME

(71) Applicant: PLUS Corporation, Tokyo (JP)

(72) Inventors: Yoshihiko Kobashi, Tokyo (JP); Ryota Yokoto, Tokyo (JP)

(73) Assignee: Plus Corporation, Tokyo (JP)

( * ) Notice: Subject to any disclaimer, the term of this patent is extended or adjusted under 35 U.S.C. 154(b) by 96 days.

(21) Appl. No.: 14/726,370

(22) Filed: May 29, 2015

(65) Prior Publication Data

US 2015/0368004 A1 Dec. 24, 2015

(30) Foreign Application Priority Data

Jun. 20, 2014 (JP) ..... 2014-127751

(51) Int. Cl.

| | |
|---|---|
| ***B65D 43/26*** | (2006.01) |
| ***E05D 3/06*** | (2006.01) |
| ***E05D 11/08*** | (2006.01) |
| ***B65D 43/14*** | (2006.01) |
| ***B65H 37/00*** | (2006.01) |

(52) U.S. Cl.

CPC ..... *B65D 43/26* (2013.01); *B65D 43/14* (2013.01); *B65H 37/005* (2013.01); *E05D 3/06* (2013.01); *E05D 11/084* (2013.01); *Y10T 16/53238* (2015.01)

(58) Field of Classification Search

CPC ..... B65D 43/26; B65D 43/14; B65D 43/164; B65D 43/262; B65D 43/265; B65D 43/267; B65D 2543/00907; B65H 37/005; E05D 3/06; E05D 11/084; B65F 1/163; Y10T 16/53238

See application file for complete search history.

(56) References Cited

U.S. PATENT DOCUMENTS

| | | | | |
|---|---|---|---|---|
| 2,312,584 A * | 3/1943 | Peterson | B60C 9/0042 222/470 |
| 6,116,476 A * | 9/2000 | Huang | B65D 47/249 222/506 |
| 6,557,717 B1 * | 5/2003 | Keck | A47G 19/2272 220/254.9 |
| 6,862,779 B1 * | 3/2005 | Lu | G06F 1/1616 16/337 |
| 6,983,514 B2 * | 1/2006 | Lu | G06F 1/1616 16/303 |
| 7,997,442 B2 * | 8/2011 | Pinelli | A47G 19/2272 220/714 |
| 8,464,895 B2 * | 6/2013 | Gilbert | A47G 19/2272 215/307 |
| 9,456,710 B2 * | 10/2016 | Blain | A45F 3/18 |

(Continued)

*Primary Examiner* — Anthony Stashick
*Assistant Examiner* — James Way
(74) *Attorney, Agent, or Firm* — Martine Penilla Group, LLP

(57) ABSTRACT

To provide a novel rotation mechanism having a smaller number of components or parts.

A double-sided tape applicator in which a rotation mechanism is incorporated includes a case and a closure 200 rotated relative to the case. A spiral sloped surface 212 is formed on a side of the closure 200. The case has an abutted member 131 provided at an end of a push member 130. When a user pushes the push member 130 to abut or compress the abutted member 131 against the sloped surface 212, the closure 200 is rotated.

7 Claims, 6 Drawing Sheets

(56) References Cited

U.S. PATENT DOCUMENTS

| | | | | |
|---|---|---|---|---|
| 2002/0073508 | A1* | 6/2002 | Rude | G06F 1/1616 16/341 |
| 2003/0163900 | A1* | 9/2003 | Rude | G06F 1/1616 16/337 |
| 2006/0048337 | A1* | 3/2006 | Lowry | E05C 17/64 16/342 |
| 2007/0029048 | A1* | 2/2007 | Lee | B65H 35/0033 156/527 |
| 2007/0205195 | A1* | 9/2007 | Yang | B65F 1/08 220/264 |
| 2007/0210093 | A1* | 9/2007 | Pinelli | A47G 19/2272 220/715 |
| 2009/0139057 | A1* | 6/2009 | Honda | B60J 5/103 16/343 |
| 2009/0151116 | A1* | 6/2009 | Lin | E05D 11/082 16/239 |
| 2013/0047378 | A1* | 2/2013 | Bohn | E05D 11/084 16/342 |
| 2013/0062304 | A1* | 3/2013 | Meyers | B65D 43/00 215/240 |
| 2013/0248531 | A1* | 9/2013 | Lane | A45C 11/20 220/262 |
| 2014/0263476 | A1* | 9/2014 | Blain | A45F 3/18 222/545 |
| 2015/0068550 | A1* | 3/2015 | Sasaki | A45D 40/222 132/295 |
| 2015/0136329 | A1* | 5/2015 | Masecar | B65H 37/005 156/577 |
| 2015/0291325 | A1* | 10/2015 | Chou | B65D 43/26 220/23.91 |
| 2015/0368004 | A1* | 12/2015 | Kobashi | B65D 43/26 220/262 |

* cited by examiner (b)

(a)

ROTATION MECHANISM AND CASE ASSEMBLY USING THE SAME

CLAIM OF PRIORITY TO RELATED APPLICATION

The application claims priority from Japanese Patent Application No. 2014-127751 filed Jun. 20, 2014, the disclosure of which is incorporated herein by reference in its entirety.

BACKGROUND OF THE INVENTION

Technical Field

The present invention relates to rotation mechanisms capable of causing rotation of a second member relative to a first member.

Background Art

Some products in the market place use a case assembly having a case with an opening formed therein and a lid which covers the opening. An example of such case assembly is a combination of a handheld case for transferrable correction tape and a closure for the case. Similar structures are widely used for transferable products of, for example, adhesive tape, double-sided tape, and decoration tape.

In such cases, the lid can usually take two positions: a position to cover the opening in the case and a position to expose the opening in the case. When using a correction tape, the closure is positioned at the position to expose the opening in the case. When the correction tape is not used, the closure is positioned at the position to cover the opening in the case.

Movement of closures of the type described may be rotation about an axis. Typical case assemblies use a combination of shaft rods and bearings to achieve such rotation in which, for example, the shaft rods are provided on the case and the bearings for receiving the respective shaft rods are formed in the closure, or vise versa.

Rotation of the closure relative to the case as described above is often made by a user by rotating the closure relative to the case with his or her hand.

On the other hand, rotation mechanisms capable of rotating a closure relative to a case almost automatically or via a single action of a user merely by using operation means (such as a button or a lever) are also known. Such rotation mechanisms, however, typically have a relatively large number of components or parts, which tends to increase costs. In addition, it is often difficult to mount such a rotation mechanism onto small items such as applicators for correction tape.

These problems associated with the rotation mechanisms are not inherent to case assemblies having a case and a lid used for items such as correction tape. Instead, similar problems are present more generally in rotation mechanisms for rotating a second member of a kind relative to a first member of another kind.

An object of the present invention is to provide a novel rotation mechanism having a smaller number of components or parts.

BRIEF SUMMARY OF THE INVENTION

In order to solve the aforementioned problems, the present applicant proposes the following invention.

The present invention is a rotation mechanism for causing rotation of a second member relative to a first member, the first member including a connector part having either a pair of shaft rods (which may be the two ends of a series of shaft rods) each defining a rotation axis or a pair of bearings for receiving the corresponding shaft rods, the second member including a first arm and a second arm having the other of the pair of shaft rods or the pair of bearings, respectively, the first arm and the second arm straddling the connector part, the rotation of the second member relative to the first member being caused on the shaft rods.

These shaft rods and the bearings are configured to attach the second member to the first member by inserting the shaft rods into the corresponding bearings with either the shaft rods or the bearings which are provided on or in the first and second arms of the second member being positioned outside of the other of the shaft rods or the bearings provided on or in the connector part of the first member.

In this rotation mechanism, the first member has a push member provided on an outer side of the first arm, the push member being configured to be moved towards the first arm in a direction along a length of the shaft rods when a user applies a force to the push member. In addition, one of opposing surfaces of the push member and the first arm has a spiral sloped surface surrounding a predetermined region around the shaft rod on the axis of the shaft rod, the spiral sloped surface being sloped in the direction along the length of the shaft rods; the other of the opposing surfaces of the push member and the first arm having an abutted member that is abutted against the sloped surface; and the second member being rotated relative to the first member on the shaft rods as the abutted member slides along the sloped surface, with a pressure between the abutted member and the sloped surface increased as a result that a user moves the push member towards the first arm.

This rotation mechanism is applicable to a combination of a first member having a connector part and a second member having first and second arms straddling the connector part. Although the term "arm" is used herein, the shapes of the first and second arms in this application are not specifically limited and any shape can be applicable. They may or may not be a shape that can be represented with a concept of the word arm such as a shape like a narrow, long part.

The connector part is straddled by the first arm and the second arm. Accordingly, one of the outer surfaces of the connector part is facing to the inner surface of the first arm, and the other of the outer surfaces of the connector part is facing to the inner surface of the second arm. The inner surfaces of the first and second arms have the shaft rods projected inward therefrom. The outer surfaces of the connector part have the bearings formed therein into which the shaft rods are inserted inwardly in a direction from the outside to the inside. Alternatively, with the relationship reversed, the bearings extending inward are formed in the inner surfaces of the first and second arms. The shaft rods are provided on the outer surfaces of the connector part extending outward therefrom. The shaft rods in this case are inserted outwardly into the corresponding bearings in a direction from the inside to the outside.

On the other hand, the rotation mechanism of this application has three features which are not used in typical conventional rotation mechanisms of the type described: the sloped surface, the abutted member and the push member, which allow rotation of the second member relative to the first member without adding any components or parts.

The push member is provided on the first member and positioned outer side of the first arm. The push member is movable towards the first arm when a user exerts a force thereto. As long as this can be done, the push member is not necessarily formed as an integral part with the first member.

Alternatively, the push member may be made as a separate component from the first member. The sloped surface is provided on one of the opposing surfaces of the push member and the first arm, that is, either the inner surface of the push member or the outer surface of the first arm. On the other hand, the abutted member is provided on the other of the opposing surfaces of the push member and the first arm, that is, either the inner surface of the push member or the outer surface of the first arm where the sloped surface is not provided. The sloped surface is a spiral surface surrounding the shaft rod on the center of the shaft rod (including an extension of the shaft rod) and is sloped relative to the longitudinal direction of the shaft rod. The abutted member is opposed to and abutted against the push member. The abutment (contact) of the abutted member and the sloped surface is preferably made on a point contact basis in consideration of reduction of frictional resistance between them. This can be achieved by, for example, using a hemispherical shape for the region where the abutted member comes into contact with the sloped surface. As described above, one of the abutted member and the sloped surface is provided on the push member and the other of them is provided on the first arm. The abutted member and the sloped surface are opposed to each other. Regardless of which of the abutted member and the sloped surface is provided on the push member, the abutted member and the sloped surface are pressed against each other when a user moves the push member towards the first arm. This causes sliding movement of the abutted member along the sloped surface, rotating the second member on the shaft rods.

The aforementioned rotation mechanism merely uses the abutted member, the sloped surface, and the push member and other components or parts such as a spring are not at least essential. Accordingly, without increasing the number of components or parts unreasonably, the rotation of the second member relative to the first member can be achieved. Besides, the abutted member may be formed integrally with either the first arm or the push member and the sloped surface may be formed integrally with the other of the first arm and the push member. This further enhances the effect of not increasing the number of components or parts.

The second member in the rotation mechanism according to this application may be attached to the first member with a play provided between the shaft rod and the bearing to allow movement of the second member in the direction along the length of the shaft rods.

In this case, the first member and the second member may have a first locking part and a second locking part, respectively, the first and second locking parts being engaged with each other when the push member is not moved by the user towards the first arm, the engaged first and second locking parts being disengaged with each other when the second member being moved in a direction from the first arm to the second arm in the direction along the length of the shaft rods as a result that the push member is moved by the user towards the first arm, the second member being configured to rotate immediately after the disengagement of the first locking part and the second locking part while releasing a strain stored in the second member before the disengagement of the first locking part and the second locking part as a result that the push member is moved by the user.

In summary, this rotation mechanism includes the first locking part and the second locking part having the function of suppressing the rotation of the second member relative to the first member. Even when the push member is moved by a user to a certain degree, the second member is not rotated relative to the first member due to the engagement between the first locking part and the second locking part. During this, the second member receives strain due to the force exerted by the abutted member or the sloped surface thereof as a result of being prevented from being rotated which otherwise can be rotated freely. When the push member is moved further, then the engagement between the first locking part and the second locking part is released. Then, the second member rotates quickly and sharply as if it were spring-loaded while releasing the strain stored therein. This rotation mechanism allows, without any spring, quick and sharp rotation of the second member similar to that achieved using a spring.

The first locking part and the second locking part may be provided on, for example, the opposing surfaces of the second arm and the connector part, respectively, or vice versa. The engagement between the first locking part and the second locking part is released in response to the movement of the second member caused as a result of the movement of the push member. Since the second arm is a part of the second member, the second arm is moved to a direction to expand the distance from the connector part when the push member is moved. It is easy to disengage the first locking part and the second locking part in response to the aforementioned movement of the second arm when the first locking part and the second locking part are provided on the opposing surfaces of the second arm and the connector part, respectively, or vice versa.

For example, one of the first locking part and the second locking part may be a recess formed in an edge of the bearing provided in one of the opposing surfaces of the second arm and the connector part, the recess being formed in the direction along the length of the shaft rods, and wherein the other of the first locking part and the second locking part may be a projection formed on or near a base of the shaft rod provided on the other of the opposing surfaces of the second arm and the connector part, the projection being extended in the direction along the length of the shaft rods, the projection being adapted to fit into the recess. With this configuration, the aforementioned movement of the second arm results in the disengagement of the first locking part and the second locking part.

In this case, the second member should be capable of storing certain level of strain using the force exerted manually by a user. Accordingly, the second member with an excessively high stiffness cannot rotate quickly and sharply. The second member may be made of, for example, a resin material.

The rotation mechanism according to this application may include an elastic body adapted to store an elastic force as the second member is moved in a direction from the first arm to the second arm in the direction along the length of the shaft rods as a result that the push member is moved by the user towards the first arm, and to increase the pressure between the abutted member and the sloped surface by exerting such a force to the second member that causes the second member to return to an original position thereof before the movement of the push member, when the engagement between the first locking part and the second locking part is released. With the aforementioned elastic body, it is possible to move the first arm of the second member closer to the push member after the disengagement of the first locking part and the second locking part. This leads to increasing the pressure between the abutted member and the sloped surface, enhancing the rotation of the second member.

The elastic body may be a leaf spring provided on the second member, the elastic body which is the leaf spring being adapted to store the elastic force with an end thereof being engaged with a third locking part provided on the first member when the second member is moved from an outside of one of the shaft rods to an outside of the other of the shaft rods in the direction along the length of the shaft rods in response to the movement of the push member being operated. With a very simple structure, the rotation of the second member can be enhanced. In addition, for example, the leaf spring may be made of a resin material and be integral with the second member when the second member is made of a resin material. This curbs the increase in number of the components or parts.

The rotation mechanism according to the present invention can be used for various applications.

For example, the first member is a case having an opening and the second member may be a lid which covers the opening when the push member is not operated and exposes the opening when the push member is operated. In this case, the second member of the case assembly having the first member and the second member can be attached to the first member through the rotation mechanism described above.

DETAILED DESCRIPTION OF THE INVENTION

A preferred embodiment of the present invention is described below with reference to the drawings.

This embodiment exemplifies a double-sided tape applicator which carries a rotation mechanism according to the present invention.

Figure 1:
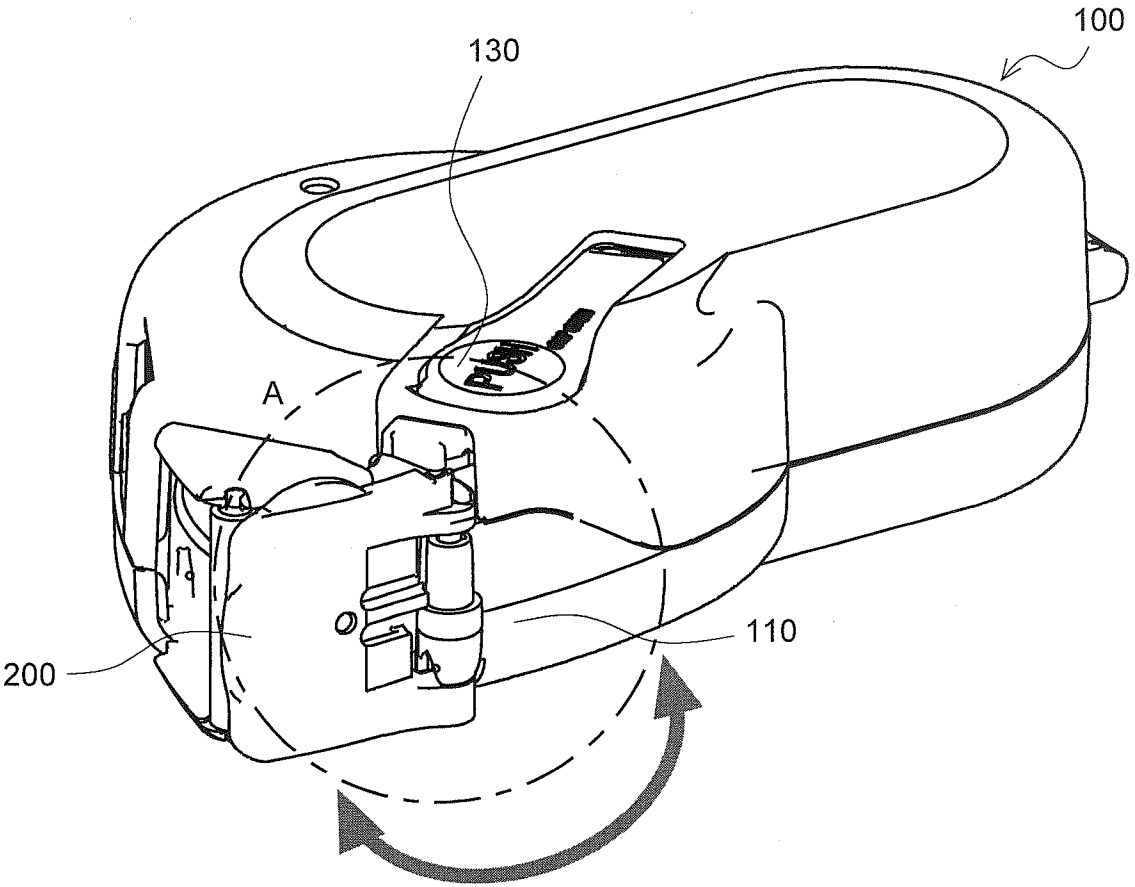
FIG. 1 is a perspective view of a double-sided tape applicator according to an embodiment of this application.

FIG. 1 shows an entire configuration of a double-sided tape applicator.

The double-sided tape applicator contains a case 100. The case 100 can be held with a hand and is made of a colorless or colored, transparent or translucent resin material. The transparency or translucency of the case 100 is to allow a user to see how much a semi-scored double-sided tape product described below remains therein. The case 100 has a closure 200. The closure 200 is for closing an opening which is not shown formed in the case 100. The closer 200 shown in FIG. 1 is covering that opening. The closure 200 is also made of a resin material.

The double-sided tape applicator according to this embodiment contains a double-adhesive laminate which is called a semi-scored double-sided tape product. Although a structure of the semi-scored double-sided tape products and a method of applying a double-adhesive laminate contained therein to a desired surface, and a structure required for that purpose are all not directly related to the present invention and known structures and/or methods may be used, an example thereof is described below.

While not illustrated in the drawing, a semi-scored double-sided tape product is made up of a release liner and a double-adhesive laminate adhered to the release liner. The release liner is a long thin strip with a width of, for example, around 1 cm. The double-adhesive laminate has a backing material tape sandwiched between adhesive layers. The double-adhesive laminate is cut into small rectangular pieces in a direction along the width thereof. These small pieces are aligned with each other and attached to the release liner. The length of each small piece obtained by cutting the double-adhesive laminate in a longitudinal direction thereof is, for example, around 3 to 4 mm. The semi-scored double-sided tape product is produced by cutting only the double-adhesive laminate adhered to the release liner without cutting the latter.

The semi-scored double-sided tape product is wound on a first rotatable spool which is not shown and is contained in the case 100. The double-sided tape applicator also has a rotatable transfer roller which is not shown, near the opening in the case 100. The semi-scored double-sided tape product is wrapped around the transfer roller with the surface thereof on the side of the release liner in contact with the transfer roller. As to the semi-scored double-sided tape product supplied to the transfer roller, when a user who holds the case 100 in one hand moves the case 100 while pressing the transfer roller along with the semi-second double-sided tape product down onto a desired surface to which the small pieces of the double-adhesive laminate are to be adhered, the small pieces of the double-adhesive laminate are removed from the release liner and are successively transferred to the desired surface. In addition, the case 100 contains a second rotatable spool which is not shown for taking up the release liner after the small pieces of the double-adhesive laminate are transferred to the desired surface. The second spool may be made up of, for example, two or more gears engaged with the first spool so that it rotates synchronously with the first spool. As described above, the semi-scored double-sided tape product is supplied from the first spool to the transfer roller where the double-adhesive laminate is adhered to the desired surface. When the semi-scored double-sided tape product is fed in cooperation with the rotation of the transfer roller, the tension exerted is transmitted through the semi-scored double-sided tape product to the first spool and the semi-scored double-sided tape product is unwound from the first spool. On the other hand, the second spool rotates as the first spool rotates, that is to say, the second spool rotates in synchronism with the rotation of the first spool. Accordingly, the used release liner can be taken up on the second spool.

The closure 200 rotates relative to the case 100 as depicted by an arrow in FIG. 1. This rotation is made by the rotation mechanism described below. After the closure 200 rotates, the opening in the case 100 is exposed at the position covered with the closure 200.

Figure 2:
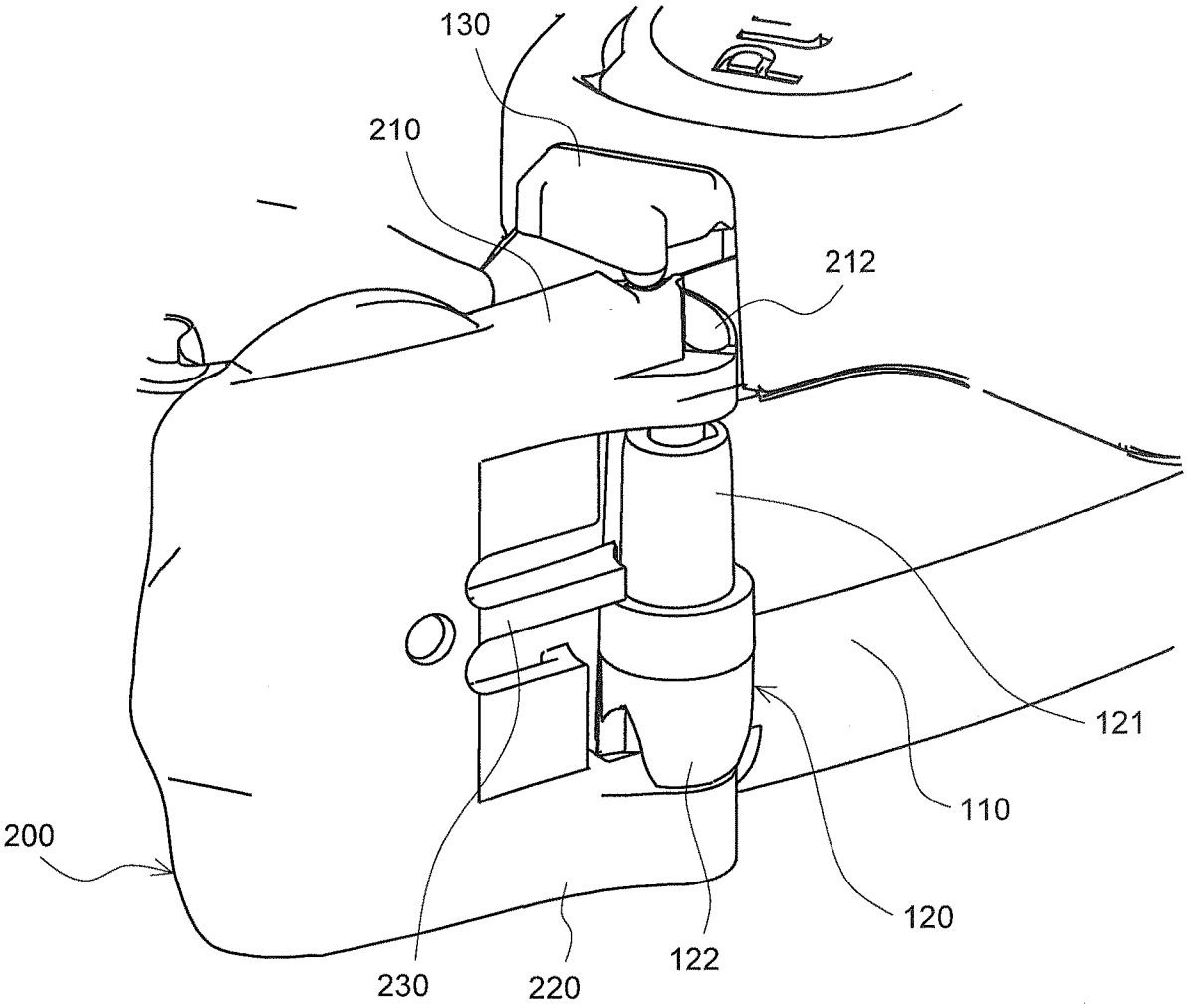
FIG. 2 is an enlarged view of the region inside the dot-dashed circle depicted by "A" of the double-sided tape applicator shown in FIG. 1.
Figure 3:
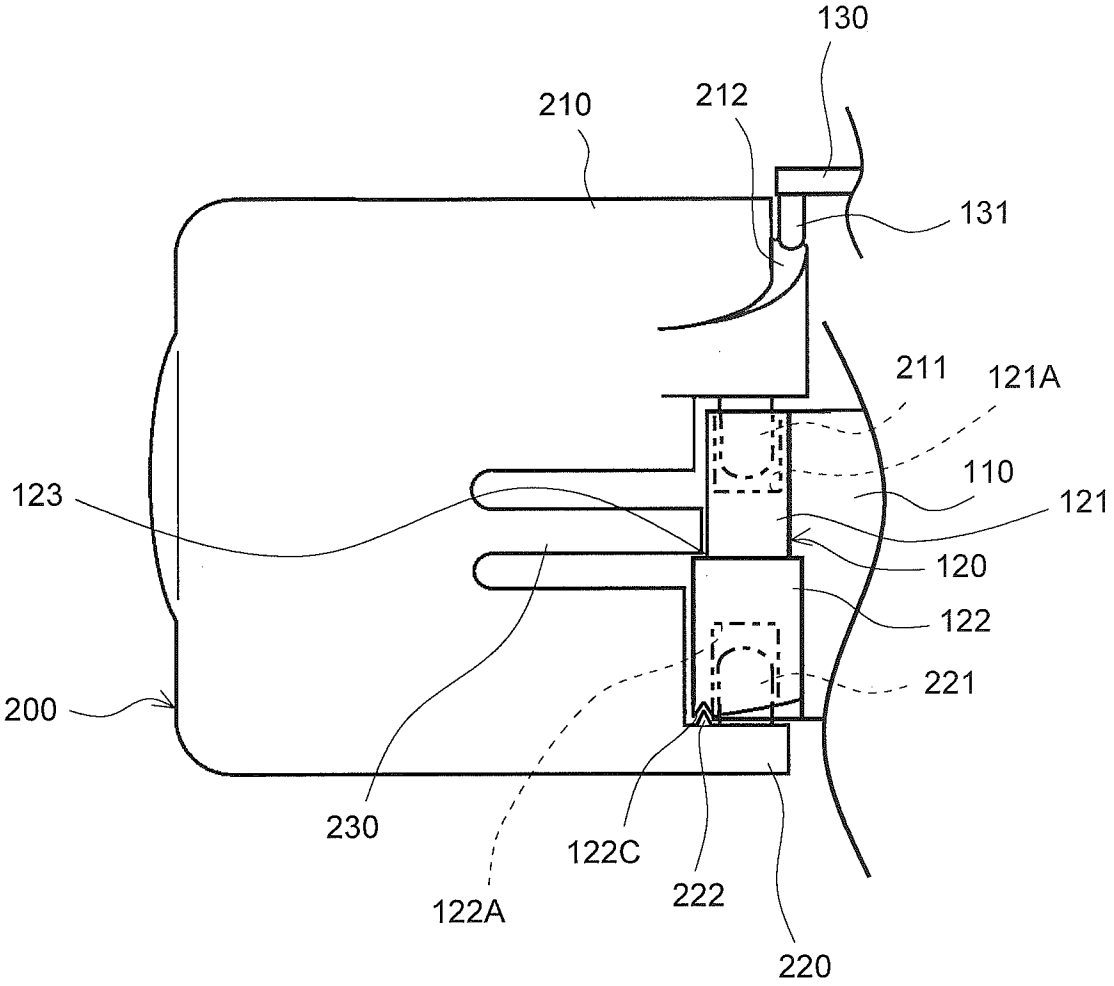
FIG. 3 is a bottom view of a closure and its surroundings of the double-sided tape applicator shown in FIG. 1.
Figure 4:
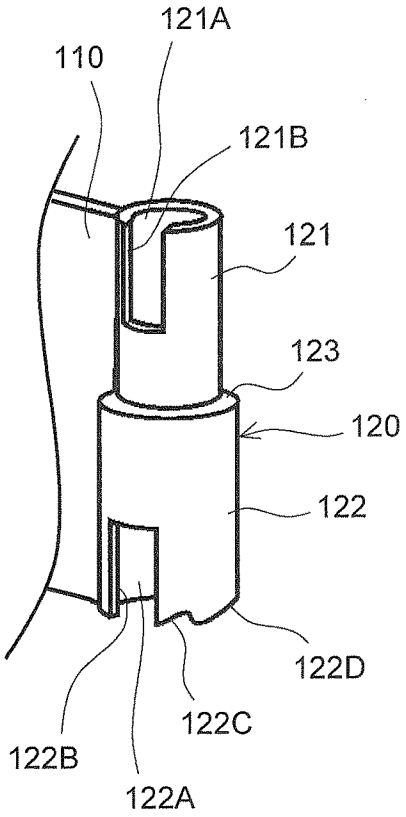
FIG. 4 is (a) a bottom view and (b) a perspective view schematically showing a structure of a part where the closure of the case of the double-sided tape applicator shown in FIG. 1 is attached.
Figure 4:
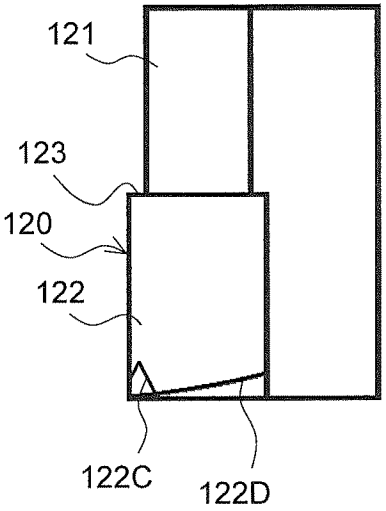
Figure 5:
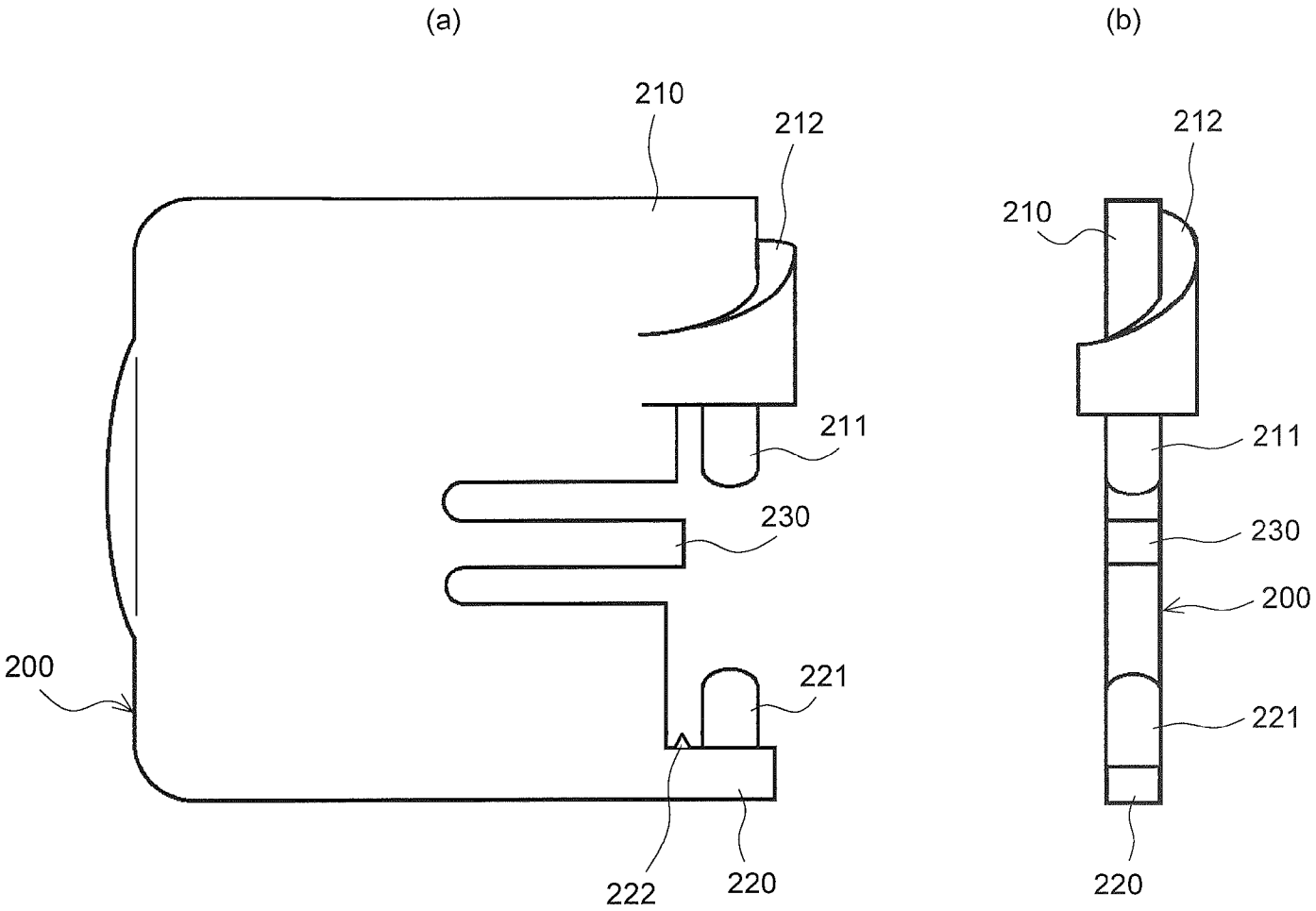
FIG. 5 is (a) a bottom view and (b) a side view schematically showing the closure of the double-sided tape applicator shown in FIG. 1.

FIG. 2 shows an enlarged view of the region inside the dot-dashed circle depicted by "A" in FIG. 1. FIG. 3 shows a bottom view of the closure 200 and its surroundings of the double-sided tape applicator. FIG. 4 shows (a) a bottom view and (b) a perspective view schematically showing a structure of a part where the closure 200 of the case 100 is attached (including components making up the rotation mechanism). FIG. 5 schematically shows (a) a bottom view and (b) a side view of the closure 200.

In the following description, the upper and lower sides of the sheet of FIG. 3 are considered as "outside" when used in conjunction with the case 100 and the closure 200. Accordingly, elements or surfaces described as "outer" in the orientation in FIG. 3 are facing "outward" towards the upper and lower sides of FIG. 3 and those described as "inner" are facing "inward", i.e., away from the upper and lower sides of FIG. 3. When an element is described as being positioned "outside" of another element, then the former element is positioned closer to the upper or lower side of FIG. 3 relative to a horizontal line through the center of the sheet, and the latter element is positioned closer to the central horizontal line.

A connector part 110 is provided on the lower surface of the case 100. The connector part 110 has a plate-like shape and is projected ahead. The connector part 110 has a rectangular shape, but not limited thereto.

A tubular member 120 is provided at the forward end of the connector part 110. The tubular member 120 has a generally hollow cylindrical shape as a whole. The tubular member 120 is made up of a thin narrow tubular member 121 and a thick wide tubular member 122. The narrow tubular member 121 and the wide tubular member 122 of different diameter meet at a step which is a third locking part 123 herein.

The narrow tubular member 121 and the wide tubular member 122 both have an opening formed in their surface facing outward. The narrow tubular member 121 and the wide tubular member 122 have internal spaces 121A and 122A therein, respectively. The internal spaces 121A and 122A are hollow cylindrical spaces that are coaxial with each other. These internal spaces 121A and 122A are for receiving shaft rods (described later), respectively, and thus serve as bearings in this application.

Slits 121B and 122B are formed in the walls defining the internal spaces 121A and 122A, respectively. The slits 121B and 122B extend inward over a certain range from the outer extremities of the internal spaces 121A and 122A, respectively. These slits 121B and 122B are for inserting the shaft rods into the internal spaces 121A and 122A, respectively. If this insertion can be made using some other method, these slits 121B and 122B are not necessarily required. The shaft rods are pushed into the internal spaces 121A and 122A in the narrow tubular member 121 and the wide tubular member 122, respectively, expanding and deforming the slits 121B and 122B.

A notch-like first locking part 122C is provided in the outer edge of the wide tubular member 122. The first locking part 122C is adapted to engage with a second locking part described later. The only requirement of the first locking part 122C is this engagement and the shape of the first locking part 122C is not limited to the illustrated one. In addition, the position where the first locking part 122C is formed is not limited to the illustrated one.

A mildly-sloped surface 122D that is slightly slanted is formed on the outer edge of the wide tubular member 122. The mildly-sloped surface 122D begins at the point to the right of the first locking part 122C in the orientation depicted in FIG. 4(*b*) and extends about half way around the wide tubular member 122. How long the mildly-sloped surface 122D should be extended is described later. The end of the mildly-sloped surface 122D continues vertically down toward the outer edge of the wide tubular member 122 along the length of the wide tubular member 122.

On the side surface of the case 100 closer to the narrow tubular member 121, a push member 130 having a generally plate-like shape is provided along the aforementioned side surface of the case 100. The push member 130 is a separate part from the case 100 and joined to the case 100 later in this embodiment, but not limited thereto. More specifically, the push member 130 is attached to the case 100 at the base thereof (i.e., the right end in the orientation in FIG. 1). A gap is present between the push member 130 and the side surface of the case 100 closer to the narrow tubular member 121. The push member 130 can therefore be moved in a direction perpendicular to the aforementioned side surface of the case 100. In other words, the push member 130 can be moved towards the side surface of the case 100 so that the gap between the push member 130 and the aforementioned side surface of the case 100 is occupied. Such movement of the push member 130 can be made when a user pushes the push member 130 with his or her finger(s) against the elasticity of the push member 130 that is made of a resin material towards the aforementioned side surface of the case 100.

At the tip of the push member 130, an abutted member 131 which is integrally formed with the push member 130 is provided in a direction generally perpendicular to the push member 130. The tip of the abutted member 131 is rounded into a generally hemispherical shape in this embodiment, but not limited thereto.

Next, the closure 200 is described.

As mentioned above, the closure 200 is made of a resin material and the entire closure 200 is integrally formed in this embodiment.

The closure 200 is generally rectangle as a whole and includes a first arm 210 and a second arm 220. A gap is provided between the first arm 210 and the second arm 220 so that the first arm 210 and the second arm 220 straddle the forward end of the connector part 110.

Cylindrical shaft rods 211 and 221 are provided on the inner surface of the first arm 210 and the second arm 220, respectively, of the closure 200. Similar to ordinary shaft rods, these shaft rods 211 and 221 are coaxial to each other. The shaft rods 211 and 221 are inserted inwardly (through the outward-facing or outer surfaces of the tubular member 120) into the internal spaces 121A and 122A, respectively, in the narrow tubular member 121 and the wide tubular member 122 which serve as bearings, using the slits 121B and 122B, respectively, as described above. In this way, the closure 200 is joined to the connector part 110 of the case 100. The shaft rods 211 and 221 are thus rotatable within the respective internal spaces 121A and 122A. In addition, slight play is provided between the shaft rods (211, 221) of the closure 200 and the respective internal spaces (121A, 122A) in the longitudinal direction of the shaft rods 211 and 221 to allow the shaft rods 211 and 221 to move slightly in the longitudinal direction thereof.

A sloped surface 212 is provided on the outer surface of the first arm 210, that is, the surface facing to the inner surface of the push member 130. The sloped surface 212 is a spiral-slope surface around the axis of the shaft rod 211 and extends over a predetermined region on the axis of the shaft rod 211. The region where the sloped surface 212 should extend is a region corresponding to an angular region within which at least the closure 200 can rotate. The sloped surface 212 is sloped only in the circumferential direction thereof and not sloped in the radial direction thereof in this embodiment, but not limited thereto. The angle of the sloped surface 212 may arbitrarily be determined so that the rotation of the closure 200 described later can be made appropriately. When the push member 130 is not pushed by the user towards the side of the case on which the aforementioned push member 130 is attached, the tip of the aforementioned abutted member 131 is slightly in contact with a place closest to the push member 130 or in the vicinity thereof.

In addition, a second locking part 222 is provided on the inner surface of the second arm 220. The second locking part 222 is a projection having a shape conforming to the aforementioned first locking part 122C. When the second locking part 222 is held within the first locking part 122C and they are engaged with each other, the closure 200 cannot basically be rotated whereas the closer 200 can be rotated when they are not engaged with each other. The only requirement for the second locking part 222 is that it can engage with the first locking part 122C and the shape of the second locking part 222 is not limited to the illustrated one and the position where the second locking part 222 is formed is not limited to the illustrated one, as long as the requirement is satisfied. It is, however, preferable that the first and second locking parts 221 and 222 are formed at such a position that their engagement is released when the closure 200 is moved down in the orientation in FIG. 3 as described below and with such a structure that their engagement is released when the closure 200 is moved down.

In addition, the closure 200 has a leaf spring 230. The leaf spring 230 is provided as a part between two slits that are formed in a part facing to the forward end of the connector part 110, between the first arm 210 and the second arm 220 of the closure 200. The length of the leaf spring 230 is determined so that the tip thereof can be engaged with the aforementioned third locking part 123 provided on the connector part 110. The tip of the leaf spring 230 is so formed that it is engaged with the third locking part 123 when the closure 200 is moved from the side of the first arm 210 to the side of the second arm 220.

How the aforementioned double-sided tape applicator is used and operated is described.

When the double-sided tape applicator is used, the closure 200 should be rotated using the rotation mechanism to expose the opening in the case 100.

In order to do so, a user is only required to push the tip of the push member 130 towards the surface where the push member 130 of the case 100 is provided.

First, before the user pushes the push member 130, the closure 200 is positioned at an upper side (i.e., its uppermost position that can be referred to as the initial position) in the orientation in FIG. 3 relative to the connector part 110 of the case 100. The reason why the closure 200 is in its uppermost position in the orientation in FIG. 3 is that, when the closure 200 is moving down, the tip of the leaf spring 230 of the closure 200 is engaged with the upper (in the orientation in FIG. 3) surface of the third locking part 123 of the connector part 110. The elastic force of the leaf spring 230 keeps the closure 200 at the position above the connector part 110 of the case 100 in the orientation in FIG. 3.

In this state, the second arm 220 is also in its uppermost position. The second locking part 222 provided on the second arm 220 is therefore fitted in the first locking part 122C and engaged with the first locking part 122C.

When the user pushes the push member 130 towards the surface where the push member 130 of the case 100 is attached, the push member 130 is moved down in the orientation in FIG. 3. In response to this, the abutted member 131 at the tip of the push member 130 pushes or compresses the sloped surface 212 provided on the first arm 210 of the closure 200, which increases the pressure between them.

When the user further pushes the push member 130, then the tip thereof is moved against the elastic force exerted by the leaf spring 230 engaged with the third locking part 123 and the closure 200 begins to move downward in the orientation in FIG. 3. During this operation, elastic energy to move the closure 200 upward is gradually stored in the leaf spring 230. In addition, in this state, the second locking part 222 is fitted in the first locking part 122C and is engaged with the first locking part 122C. Accordingly, without the engagement between the second locking part 222 and the first locking part 122C, the abutted member 131 moved downward in the orientation in FIG. 3 by the user pushing the push member 130 compresses the sloped surface 212, increasing the pressure exerted between them. The closure 200 having the sloped surface 212 should begin to rotate on the axes of the shaft rods 211 and 221 with the left end of the closure 200 in the orientation in FIG. 3 moving in the direction towards the viewer from the plane of that figure, as the abutted member 131 is moved downward in the orientation in FIG. 3. The closure 200, however, cannot rotate due to the aforementioned engagement. The strain caused is then gradually stored in the closure 200.

Figure 6:
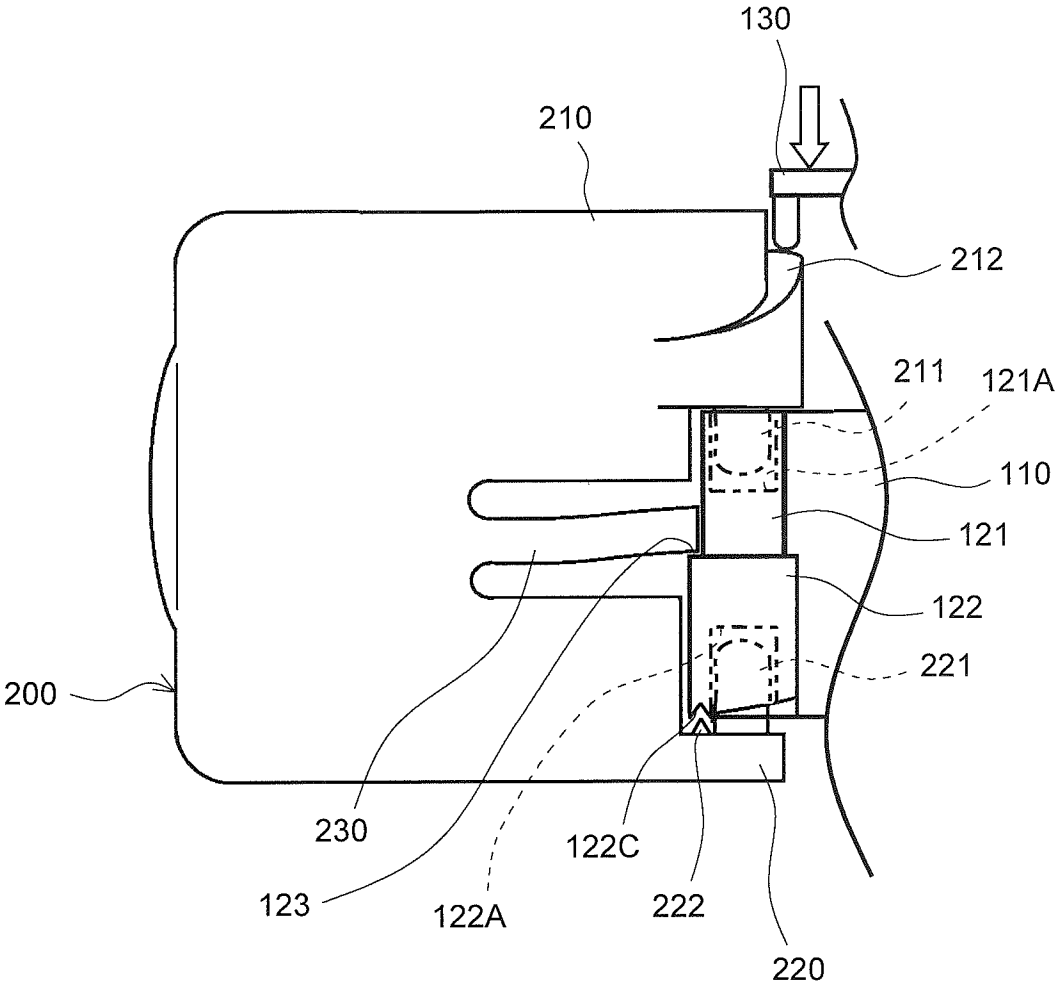
FIG. 6 is a bottom view for describing the closure and its surroundings of the double-sided tape applicator shown in FIG. 1.

When the user further pushes the push member 130, the closure 200 is moved downward in the orientation in FIG. 3, storing more and more elastic energy used to move the closure 200 upward in the leaf spring. After the closure 200 is moved downward in the orientation in FIG. 3 to a certain degree, the second arm 220 is also moved downward. This causes the second locking part 222 to escape from the first locking part 122C to release the engagement between them, as shown in FIG. 6. The closure 200 in this state is free to rotate as a result of this disengagement. Accordingly, it rotates on the axes of the shaft rods 211 and 221 relative to the case 100 with the left end of the closure 200 in the orientation in FIG. 6 moving in the direction towards the viewer from the plane of that figure while causing the sloped surface 212 to slide along the abutted member 131 of the push member 130 (relatively, causing the tip of the abutted member 131 sliding on the sloped surface 212). This rotation is made while releasing the strain stored in the closure 200. An appropriate choice of a material to form the closure 200 (such as a resin material) results in quick and sharp rotation of the closure as if it were spring-loaded even without any spring to directly exert a force for rotation to the closure 200. When the engagement between the second locking part 222 and the first locking part 122C is released and the closure 200 begins to rotate, the leaf spring 230 that has been displaced upward in the orientation in FIG. 6 while storing the elastic energy pushes at the tip thereof the third locking part 123 downward in the orientation in FIG. 6. As a reaction, the closure 200 is forced to move upward relative to the connector part 110. This upward movement of the closure 200 serves to increase the pressure between the sloped surface 212 of the closure 200 and the abutted member 131 of the push member 130, which also contributes to increasing the momentum of rotation of the closure 200.

In this embodiment, the closure 200 rotates through almost 180 degrees from the position closing the opening in FIG. 1 to the position where the closure 200 is located opposite to the tubular member 120, when described using FIG. 1 as an example. After completion of such rotation, the second locking part 222 of the closure 200 does not interfere with the outer surface of the wide tubular member 122 because the second locking part 222 can enter the gap formed between the second arm 220 and the outer surface of the wide tubular member 122 at the position corresponding to the end of the aforementioned mildly-sloped surface 122D. The mildly-sloped surface 122D may be designed so that the tubular member 120 and the second locking part 222 do not interfere with each other after the completion of the rotation of the closure 200. It is noted that the tubular member 120 does not necessarily have the mildly-sloped surface 122D as long as the interference between the tubular member 120 and the second locking part 222 can be avoided after the completion of the rotation of the closure 200.

The closure 200 in this state remains its rotated position and the opening in the case 100 remains exposed even when the user stops pushing the push member 130.

The double-sided tape applicator is now ready to use. The way to use is not different from that for ordinary double-sided tape applicators and is already described schematically, so any repeated description here is omitted.

When the user has finished using the double-sided tape applicator, he or she returns the closure 200 to the position for covering the opening in the case 100 shown in FIG. 1. For this movement, the closure 200 also rotates on the axes of the shaft rods 211 and 221 but this rotation is done by the user holding the closure 200 with his or her fingers.

When the closure 200 is returned to the position shown in FIG. 1, the relationship between the closure 200 and the connector part 110 is again as shown in FIG. 3.

<Modified Version>

In the double-sided tape applicator according to the aforementioned embodiment, the internal spaces 121A and 122A that serve as the bearings are provided in the outer surfaces of the connector part 110 through the tubular member 120 and the shaft rods 211 and 221 are provided on the inner surface of the first arm 210 and the second arm 220, and the shaft rods 211 and 221 provided on the closure 200 are inserted inwardly through their outer side into the internal spaces 121A and 122A, respectively.

The positional relationship between the internal spaces (121A, 122A) and the shaft rods (211, 221) can be reversed. More specifically, shaft rods similar to the shaft rods 211 and 221 may be provided on the outer surfaces of the connector part 110 and bearings corresponding to the internal spaces 121A and 122A may be formed in the inner surfaces of the first arm 210 and the second arm. In this case, the shaft rods may be fitted in the bearings in the closure 200, with each bearing positioned more outward than the end (tip) of the corresponding shaft rod. The shaft rods similar to the shaft rods 211 and 221 may be achieved using both ends of a single shaft rod.

Such a double-sided tape applicator functions in a manner similar to the double-sided tape applicator in the aforementioned embodiment.

In addition, in the aforementioned embodiment, the abutted member 131 is provided on the inner surface of the push member 130 and the sloped surface 212 is provided on the outer surface of the first arm 210 of the closure 200.

The relationship between the abutted member 131 and the sloped surface 212 can also be reversed. The sloped surface 212 may be provided on the inner surface of the push member 130 and the abutted member 131 may be provided on the outer surface of the first arm 210 of the closure 200 in a mirror-image relation with regard to the aforementioned embodiment as the elements in FIGS. 3 and 6 are inverted upside down.

In such a case, when the push member 130 is pushed downward in the orientation in FIG. 3, the sloped surface 212 provided at the tip of the push member 130 and facing downward in the orientation in FIG. 3 is pressed against the abutted member 131 positioned beneath the push member 130 and projecting upward in the orientation in FIG. 3. The resulting rotation of the closure 200 is identical to that described in the aforementioned embodiment.

The invention claimed is:

1. A rotation mechanism for causing rotation of a second member relative to a first member, the first member including a connector part having either a pair of shaft rods each defining a rotation axis or a pair of bearings for receiving the corresponding shaft rods, the second member including a first arm and a second arm having the other of the pair of shaft rods or the pair of bearings, respectively, the first arm and the second arm straddling the connector part, the rotation of the second member relative to the first member being caused on the shaft rods;

the shaft rods and the bearings being adapted to attach the second member to the first member by inserting the shaft rods into the corresponding bearings with either the shaft rods or the bearings which are provided on or in the first and second arms of the second member being positioned outside of the other of the shaft rods or the bearings provided on or in the connector part of the first member;

the first member having a push member provided on an outer side of the first arm, the push member being configured to be moved towards the first arm in a direction along a length of the shaft rods when a user applies a force to the push member;

one of opposing surfaces of the push member and the first arm having a spiral sloped surface surrounding a predetermined region around the shaft rod on the axis of the shaft rod, the spiral sloped surface being sloped in the direction along the length of the shaft rods;

the other of the opposing surfaces of the push member and the first arm having an abutted member that is abutted against the sloped surface; and the second member being rotated relative to the first member on the shaft rods as the abutted member slides along the sloped surface, with a pressure between the abutted member and the sloped surface increased as a result that a user moves the push member towards the first arm.

2. The rotation mechanism according to claim 1, wherein the second member is attached to the first member with a play provided between the shaft rod and the bearing to allow movement of the second member in the direction along the length of the shaft rods, the first member and the second member having a first locking part and a second locking part, respectively, the first and second locking parts being engaged with each other when the push member is not moved by the user towards the first arm, the engaged first and second locking parts being disengaged with each other when the second member being moved in a direction from the first arm to the second arm in the direction along the length of the shaft rods as a result that the push member is moved by the user towards the first arm, the second member being configured to rotate immediately after the disengagement of the first locking part and the second locking part while releasing a strain stored in the second member before the disengagement of the first locking part and the second locking part as a result that the push member is moved by the user.

3. The rotation mechanism according to claim 2, wherein the first locking part and the second locking part are provided on the opposing surfaces of the second arm and the connector part, respectively, or vice versa.

4. The rotation mechanism according to claim 3, wherein one of the first locking part and the second locking part is a recess formed in an edge of the bearing provided in one of the opposing surfaces of the second arm and the connector part, the recess being formed in the direction along the length of the shaft rods, and wherein the other of the first locking part and the second locking part is a projection formed on or near a base of the shaft rod provided on the other of the opposing surfaces of the second arm and the connector part, the projection being extended in the direction along the length of the shaft rods, the projection being adapted to fit into the recess.

5. The rotation mechanism according to claim 2, comprising an elastic body adapted to store an elastic force as the second member is moved in a direction from the first arm to the second arm in the direction along the length of the shaft rods as a result that the push member is moved by the user towards the first arm, and to increase the pressure between the abutted member and the sloped surface by exerting such a force to the second member that causes the second member to return to an original position thereof before the movement of the push member, when the engagement between the first locking part and the second locking part is released.

6. The rotation mechanism according to claim 5, wherein the elastic body is a leaf spring provided on the second member, the elastic body which is the leaf spring being adapted to store the elastic force with an end thereof being engaged with a third locking part provided on the first member when the second member is moved from an outside of one of the shaft rods to an outside of the other of the shaft rods in the direction along the length of the shaft rods in response to the movement of the push member being operated.

7. A case assembly wherein:

the first member is a case having an opening;

the second member is a lid which covers the opening when a push member is not operated and exposes the opening when the push member is operated; and the second member is attached to the first member using the rotation mechanism according to claim 1.

* * * * *